US005353012A

United States Patent [19]

Barham et al.

[11] Patent Number: 5,353,012

[45] Date of Patent: Oct. 4, 1994

[54] BED POSITION AND ACTIVITY SENSING APPARATUS

[75] Inventors: Russell Barham, Fort Worth; William B. Basham, Bedford; Tommy E. Hyde, Grand Prairie, all of Tex.

[73] Assignee: Bartronix, Inc., Fort Worth, Tex.

[21] Appl. No.: 882,696

[22] Filed: May 14, 1992

[51] Int. Cl.[5] ..... G08B 23/00; H01H 3/02

[52] U.S. Cl. ..... 340/573; 128/782; 200/85 R; 340/666

[58] Field of Search ..... 340/573, 666, 686, 526, 340/667; 200/85 R; 128/774, 782, 721, 714; 324/691, 713; 364/567; 177/199–200, 245, 144; 73/862.627

[56] References Cited

U.S. PATENT DOCUMENTS

| | | | |
|---|---|---|---|
| 2,644,332 | 7/1953 | Ulrich | 73/172 |
| 3,760,794 | 9/1973 | Basham | 128/722 |
| 3,898,981 | 8/1975 | Basham | 128/722 |
| 3,926,177 | 12/1975 | Hardway, Jr. et al. | 340/573 X |
| 3,961,201 | 6/1978 | Rosenthal | 307/116 |
| 3,991,746 | 11/1976 | Hanna | 128/722 |
| 4,020,482 | 4/1977 | Feldl | 340/573 |
| 4,146,885 | 3/1979 | Lawson, Jr. | 340/573 |
| 4,163,449 | 8/1979 | Regal | 128/886 |
| 4,175,263 | 11/1979 | Triplett et al. | 340/573 |
| 4,179,692 | 12/1979 | Vance | 340/573 |
| 4,195,287 | 3/1980 | McCoy et al. | 340/521 |
| 4,228,426 | 10/1980 | Roberts | 340/573 |
| 4,242,672 | 12/1980 | Gault | 340/573 |
| 4,264,904 | 4/1981 | McCoy et al. | 340/521 |
| 4,295,133 | 10/1981 | Vance | 340/573 |
| 4,315,238 | 2/1982 | Eventoff | 338/99 |
| 4,484,043 | 11/1984 | Musick et al. | 200/85 R |
| 4,539,560 | 9/1985 | Fleck et al. | 340/573 |
| 4,565,910 | 1/1986 | Musick et al. | 200/85 R |
| 4,633,237 | 12/1986 | Tucknott et al. | 340/573 |
| 4,657,025 | 4/1987 | Orlando | 128/671 |
| 4,700,180 | 10/1987 | Vance | 340/573 |
| 4,738,264 | 4/1988 | Orlando | 128/671 |
| 4,907,845 | 3/1990 | Wood | 340/573 |

*Primary Examiner*—Thomas Mullen

*Attorney, Agent, or Firm*—Andrew J. Dillon; Mark D. Perdue

[57] ABSTRACT

A sensing and detecting apparatus includes an elongate sensor for placement parallel to one axis of a bed. The sensor includes a first and second conductive members, the first conductive member having a resistance-per-unit-length substantially different from that of the second conductive member. One of the conductive members is electrically coupled to a source of electrical power wherein the weight of the body in the bed urges the first and second conductive members together to define an electrical path for output of a sensor signal, which varies in magnitude responsive to the position of the body along the sensor. The apparatus according to the present invention further includes an alarm circuit, with means for comparing the sensor signal to predetermined position and activity level values, and triggering an alarm or alarm signal in the event the position and or activity level values are exceeded.

9 Claims, 3 Drawing Sheets

BED POSITION AND ACTIVITY SENSING APPARATUS

BACKGROUND OF THE INVENTION

1. Field of the Invention

This invention relates in general to systems for detecting persons occupying beds, and in particular to a system for detecting the position and activity level of a body in a bed. Still more particularly, the present invention relates to systems for triggering an alarm under certain conditions relating to a body within a bed.

2. Summary of the Prior Art

Injuries to bed-ridden patients are a major concern the health care and convalescence industries. Bed-ridden patients can be injured by falling out of a bed while in a state of delirium, or by falling while attempting to arise from the bed in a weakened or fatigued state. Therefore, it is useful for nurses or other supervisory personnel to be kept abreast of the activity and position of a patient or person lying in a bed. The ability to monitor remotely a patient's position and activity level in a bed permits closer and more careful supervision of that patient.

Many systems and devices are known that detect the presence, activity level, and other vital signs of a patient or person lying upon a bed. Some of these systems employ pressure transducers for the purpose of detecting heartbeat and respiratory rate (U.S. Pat. No. 4,738,264, Apr. 19, 1988, to Orlando). Such systems, however, are complex and incapable of detecting the position of a patient in the bed.

Other systems employ binary electrical switches to detect the presence or absence of a person in a bed (U.S. Pat. No. 4,700,190, Oct. 13, 1987, to Vance). These systems, again, are incapable of detecting and indicating the position or activity level of a patient within a bed.

Still another known system employs a sensor having an array of binary electrical switches within the bed, and employs a microcomputer or microprocessor to detect which of the switches are closed to indicate an impending attempt to rise from the bed by the patient (U.S. Pat. No. 4,633,237, Dec. 30, 1986, to Tucknott et al.) Such a system is overly complex, and subject to malfunction if any single switch in the array malfunctions.

Still other systems employ fluid (pneumatic or hydraulic) sensors to detect the presence of a patient in a bed (U.S. Pat. No. 4,175,263, Nov. 20, 1979, to Triplett et al.; U.S. Pat. No. 4,020,428, Apr. 26, 1977, to Feldl). These systems have bulky sensors, which are uncomfortable for the patient to lie upon. Also, these systems require complicated detection circuitry and are susceptible to malfunction if the fluid-containing sensor is punctured.

It is therefore desirable to provide a simple, low-cost, easily replaceable, and reliable system for detecting the position and activity level of a patient lying upon a bed.

SUMMARY OF THE INVENTION

It is therefore an object of the present invention to provide an improved system for detecting the position and activity level of a body lying in a bed, and for triggering an alarm in the event certain body position and activity level conditions are met.

It is another object of the present invention to provide such an apparatus that is both low-cost and easily replaceable.

It is yet another object of the present invention to provide such an apparatus that does not require complex circuitry for operation.

These and other objects are accomplished by providing a bed position and activity level sensing and detecting apparatus including an elongate sensor for placement parallel to one axis of a bed. The sensor includes a first and second conductive members, the first conductive member having a resistance-per-unit-length substantially different from that of the second conductive member. One of the conductive members is electrically coupled to a source of electrical power wherein the weight of the body in the bed urges the first and second conductive members together to define an electrical path for output of a sensor signal, which varies in magnitude responsive to the position of the body along the sensor. The apparatus according to the present invention further includes an alarm circuit, with means for comparing the sensor signal to predetermined position and activity level values, and triggering an alarm or alarm signal in the event the position and or activity level values are exceeded.

Other objects, features, and advantages of the present invention will become apparent to those skilled in the art after examination of the following drawings and detailed description of the present invention.

DESCRIPTION OF THE PREFERRED EMBODIMENT

Figure 1:
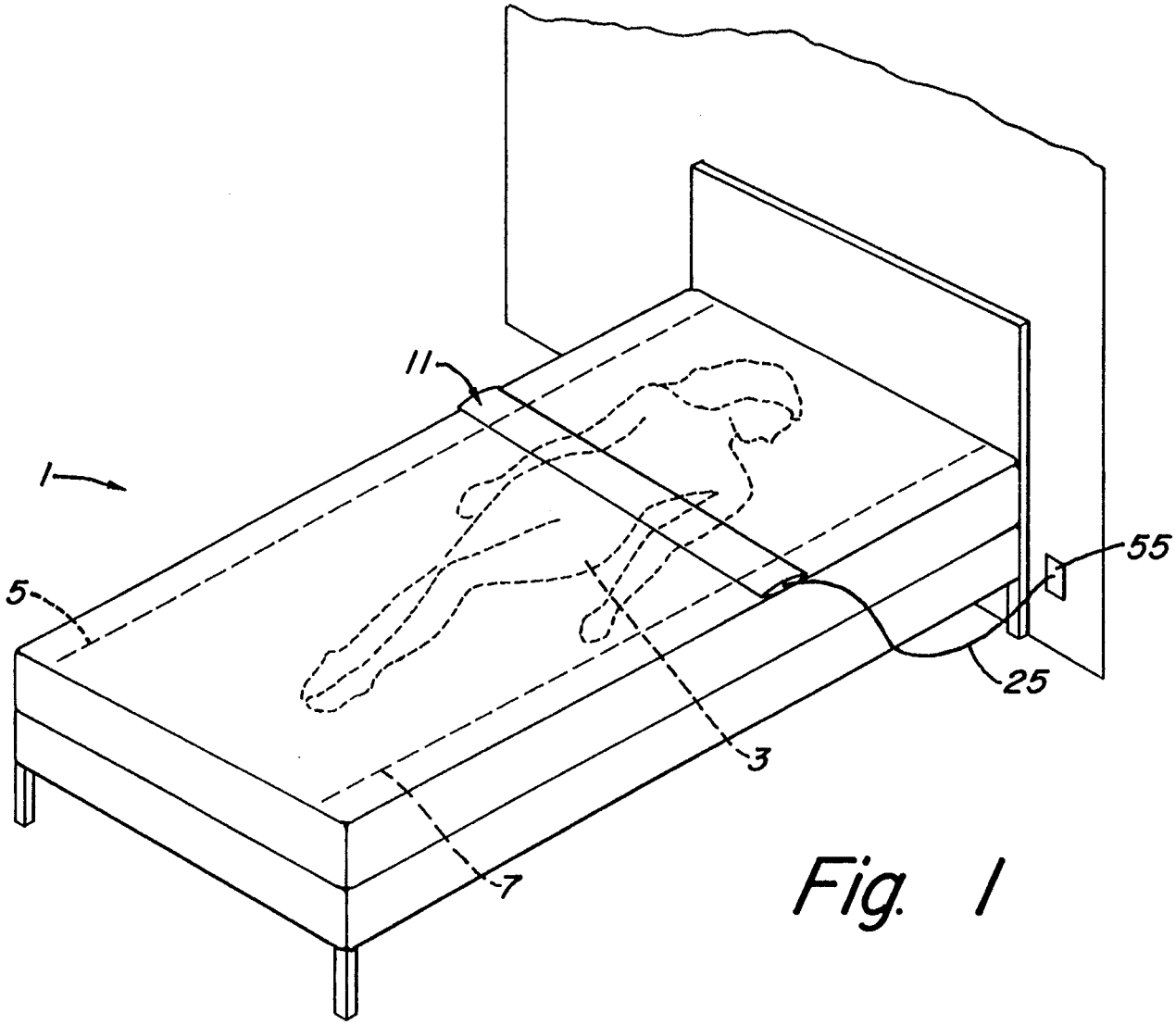
FIG. 1 is a perspective view of a typical bed having an apparatus according to the present invention disposed thereon, and a person lying upon the bed and apparatus according to the present invention.

With reference now to the figures and in particular with reference to FIG. 1, there is depicted a typical bed 1, having a person 3 lying thereon. Bed 1 shown is a typical household bed; however, the present invention is equally adequate in hospital beds having rails and/or adjustable contours. Person 3 may be a child, invalid, recovering patient, or any person susceptible to personal endangerment by falling out of, or arising from, bed 3. Danger zones 5 and 7 are located parallel to a longitudinal axis (not shown) of bed 3, and are spaced inwardly from left and right longitudinal edges of bed 3. These danger zones 5 and 7 are chosen somewhat arbitrarily by person 3 or supervisory personnel to define locations in bed 1 that are deemed dangerous for person 3 to occupy in that the presence of person 3 in areas bounded by danger zones 5 and 7 indicates the imminent departure, voluntary or otherwise, of person 3 from bed 1.

A bed sensor 11 according to a preferred embodiment of the present invention is shown disposed along an axis of and on an upper surface of bed 1, and under person 3. As will be discussed below, bed sensor 11 is preferably constructed to detect the presence of person 3 within areas defined by danger zones 5 and 7, and to trigger an alarm signal to alert person 3, or supervisory personnel, of the impending departure of person 3 from bed 1.

Bed sensor 11 is electrically coupled to a power supply (not shown) and an alarm circuit (not shown) by an electrical conductor cable 25, in this case a multiple-conductor cable. Cable 25 is connected to wall plug 55, which in turn is connected to an electrical power source (not shown), alarm circuit (not shown), and an alarm or nurse interface panel (not shown).

Figure 2:
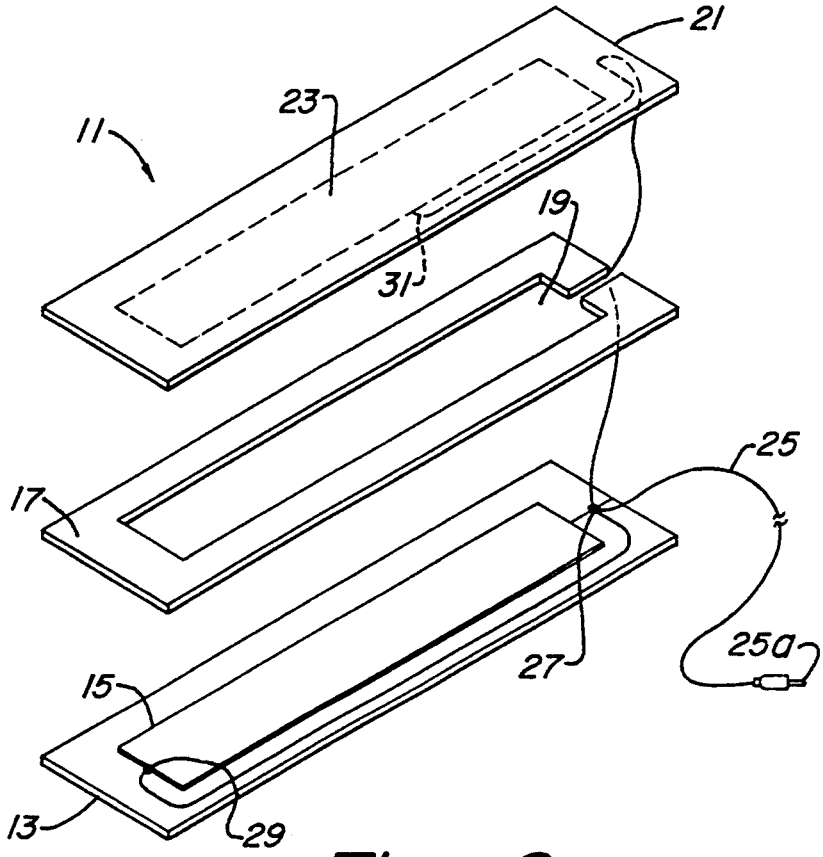
FIG. 2 is an exploded, perspective view of a preferred embodiment of the bed sensor according to the present invention.

Referring now to FIG. 2, an exploded, perspective view of a bed sensor constructed according to a preferred embodiment of the present invention is depicted.

A first elongate plastic cover member 13 has a layer of conductive material having a selected resistivity formed thereon that defines a first conductive member 15, having a selected first resistance-per-unit-length of elongate sensor 11.

A spacer member 17 is formed of an electrically insulating material, and is substantially coextensive at its periphery with first elongate plastic cover member 13 having first conductive member 15 formed thereon. Spacer member 17 has an elongate slot 19 formed therein of a dimension smaller than the outer periphery of spacer 17.

A second elongate plastic cover member 21 has a layer of conductive material having a selected resistivity that defines a second conductive member 23 having a selected second resistance-per-unit-length of second elongate plastic cover member 21.

The second resistance-per-unit-length defined by layer 23 of conductive material is, in accordance with a preferred embodiment of the present invention, substantially different from the resistance-per-unit-length defined by first layer of conductive material 15.

Electrical conductor 25 is physically attached to first elongate plastic cover member. In a preferred embodiment of the present invention, electrical conductor 25 is a multi-wire cable having a multi-pin connector **25*a* at a terminal end. One wire 27 of electrical conductor 25 is electrically coupled to a first end of first conductive member 15 for delivery of electric current from an electrical power source (not shown). A ground wire 29 of electrical conductor 25 is electrically coupled to an opposite end of first conductive member 15 to electrically ground the first conductive member 15. A third wire 31 of electrical conductor 25 is electrically coupled to an intermediate point 31, or output node, along the second conductive member 23**.

Figure 3:
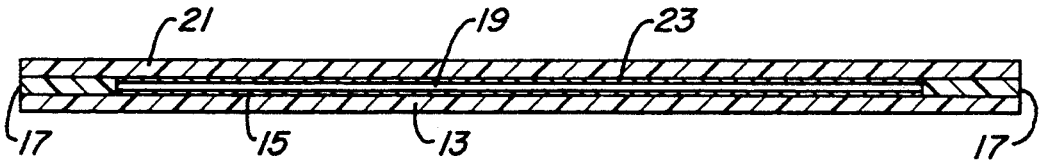
FIG. 3 is a lateral sectional view of the bed sensor of FIG. 2, the section taken at a medial point along the sensor.

With reference to FIG. 3, a lateral cross-section view of the bed sensor 11 of FIG. 2 is depicted. First elongate plastic cover member 13, spacer member 17, and second elongate plastic cover member 21 are fused together at their peripheral edges to form an elongate, electrically insulated, fluid-tight bed sensor 11. Spacer member 17 is disposed intermediate first cover member 13 and second cover member 21 and maintains first cover member 13 and second cover member 21 in a normally spaced-apart relationship. Slot 19 in spacer member 17 defines an air gap between first conductive member 15 and second conductive member 17 in the normally spaced-apart relationship. Thus, in the normally spaced-apart relationship, first conductive member 15 and second conductive member 23 are not electrically coupled. Assembly of a bed sensor according to the present invention may be accomplished in a variety of conventional ways. First and second conductive members 15, 23 could be metallic foils affixed to first elongate plastic cover member 13 and second elongate plastic cover member 21, respectively, by adhesive. Assembly of the components could then be accomplished by heat-welding the components together along outer peripheral edges of first elongate, fluid-tight sensor member 13, second elongate, fluid-tight, sensor member 21, and spacer member 17.

In a preferred embodiment of the present invention, the components are assembled using tape switch technology. The resulting bed sensor is thin, light in weight, inexpensive to produce, fluid-tight, electrically insulated, and inexpensive to replace.

Figure 4:
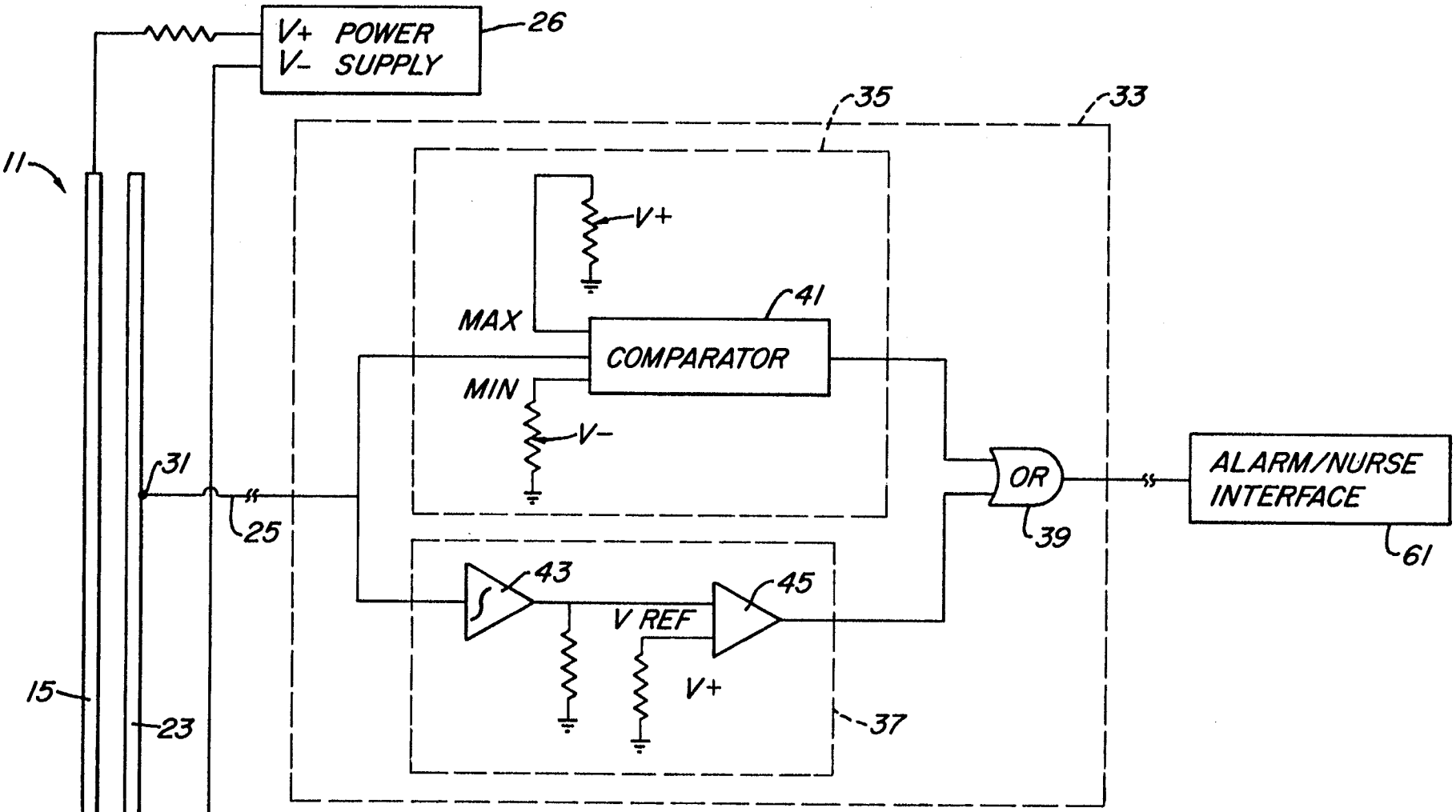
FIG. 4 is a schematic of a preferred embodiment of the present invention.

Referring now to FIG. 4, an electrical schematic of a preferred embodiment of the apparatus of the present invention is shown. Elongate sensor 11 has first conductive member 15 electrically coupled to an electrical power source 26 at nodes 27 and 29. Second conductive member 23 is electrically coupled at output node 31 to electrical conductor 25. Electrical conductor 25 is electrically coupled to alarm circuit 33. Alarm circuit 33 comprises position detector circuit 35, activity detector circuit 37, and output circuit 39. Alarm circuit 33 is connected to an alarm or nurse interface circuit 61. Alarm or nurse interface circuit 61 is conventional and may be a local alarm comprising a blinking light, siren, or the like. Alternatively, alarm or nurse interface circuit 61 could be a hard-wired system in a hospital room adapted to receive various signals for triggering alarms or displays at a remote location such as a nurses' station.

In the preferred embodiment of the present invention, position detector circuit 35 of alarm circuit 33 comprises a conventional comparator having an upper reference voltage $V_{MAX}$ and a lower reference voltage $V_{MIN}$. Comparator 41 generates a position signal in the event the input signal to comparator 41 exceeds the upper reference voltage $V_{MAX}$, or falls below the lower reference voltage $V_{MIN}$.

Activity detector circuit 37 of alarm circuit comprises an integrator 43 with its output electrically coupled to a second comparator 45. Integrator 43 integrates the quantity of changes in sensor output signal signal over time and generates an output signal that varies in relation to the quantity of changes in the input signal over time. Bleed resistor 44 conditions an output signal from integrator 43 for input into comparator 45. Comparator 45 receives an input signal from integrator 43 and a reference voltage $V_{REF}$, and generates an output signal in the event input signal from integrator 43 exceeds reference voltage $V_{REF}$.

Output circuit 39 of alarm circuit 33 is simply a gate for producing a uniform alarm signal from alarm circuit 33 in the event conditions controlled by position detector circuit 35 and activity detector circuit 37 are met. In a preferred embodiment of the present invention, output circuit 39 of alarm circuit 33 comprises a logical OR gate and produces a uniform digital signal for triggering an alarm or nurse interface 61.

Referring now to FIGS. 1, 3, and 4 the operation of the patient position and activity level sensor according to the present invention will be discussed. Patient 3 lying upon bed 1, and therefore upon elongate sensor 11, will urge together elongate plastic cover members 13 and 21. In turn, first and second conductive members 15 and 13 are urged together into electrical contact, thereby defining an electrical path from an electrical power source 26, through first conductive member 15, through second conductive member 23, to generate an electrical output signal at output node 31.

Due to the substantial difference between the resistance-per-unit-length of the first conductive member 15 and the second conductive member 23, the output signal from node 31 will vary in magnitude in relationship to the position of patient 3 along the length of elongate sensor 11. Sensor output signal is carried from output node 31 to alarm circuit 33 via electrical conductor 25.

Position detector circuit 35 of alarm circuit 33 receives the sensor output signal, and compares it to reference voltages $V_{MAX}$, $V_{MIN}$. Reference voltages $V_{MAX}$, $V_{MIN}$ are selected to correspond to danger zones (shown as 5 and 7 in FIG. 1), which are selected arbitrarily by supervisory personnel to indicate the imminent danger of departure from bed 1 by by patient 3. In the event sensor output signal exceeds or falls below reference voltages $V_{MAX}$, $V_{MIN}$ (thereby indicating that patient 3 is in a position to fall out of or depart from bed 1), comparator 41 of position detector circuit 35 will output a position signal to output circuit 39, thereby triggering an alarm or display on nurse interface panel 61.

Sensor output signal also is received by activity detector circuit 37 of alarm circuit 33. The quantity of changes in sensor output signal indicates whether patient 3 is moving across the surface of bed 1. If the quantity of changes in sensor output signal varies significantly over time, indicating restlessness of patient 3, it is desirable to trigger an alarm signal. Integrator 43 of activity detector circuit 37 integrates the quantity of changes in the sensor output signal over time. Integrator 43 generates an output that varies as a function of the quantity of changes in the magnitude of the sensor signal over time. This integrator output signal is received by comparator 45 of activity detector circuit 37. Comparator 45 also receives a reference voltage $V_{REF}$. Reference voltage $V_{REF}$ is selected to correspond to a level of restlessness or activity of patient 3 that is determined to be undesirable. If output signal from integrator 43 exceeds reference voltage $V_{REF}$, comparator 45 generates an activity signal that is received by output circuit 39 of alarm circuit 33, triggering an alarm or display on nurse interface panel 61.

The bed position and activity level sensing apparatus according to the present invention provides significant advantages.

One advantage of the present invention is that the bed sensor is light in weight, not bulky, extremely simple in construction and operation, and therefore inexpensively replaced. Because equipment used in care of contagiously ill patients may serve as a carrier of disease or infection to subsequent patients, the low-cost disposability of the apparatus according to the present invention is extremely advantageous.

Another advantage of the present invention is its ability to detect position and activity levels of bed-ridden patients with a minimum of complicated and expensive electrical componentry. The simplicity of the present invention contributes to its reliability and low cost, which in turn facilitates easy and inexpensive replacement of sensors according to the present invention.

The present invention has been described with reference to a preferred embodiment. Those skilled in the art will appreciate that the present invention is susceptible to various changes and modifications without departing from the scope of the invention.

We claim:

1. An apparatus for detecting the relative location of a body lying upon a bed, said apparatus comprising:

an electrical power source; and a single elongate sensor disposed upon said bed and parallel to at least one axis thereof, said elongate sensor having a longitudinal axis defining a plurality of points along said elongate sensor that are at least partially coextensive with a range of motion of said body in said bed, said elongate sensor having first and second electrically conductive members, one of said electrically conductive members being electrically coupled to said electrical power source, said body lying upon said bed and at least partially upon said sensor and urging said electrically conductive members into electrically conductive contact at least one of said plurality of points, wherein said sensor provides a sensor signal whose magnitude depends upon which of said plurality of points along said sensor that said body is lying upon wherein said sensor detects said body lying upon said at least one of said plurality of points and said sensor signal provides an indication of the relative location of said body in said bed.

2. The apparatus according to claim 1 wherein said elongate sensor comprises:

an elongate first conductive member having a first selected resistance-per-unit-length;

an elongate second conductive member having a second selected resistance-per-unit-length, which is different from the first resistance-per-unit length of said first conductive member, and said elongate second conductive member disposed coextensively with said first elongate conductive member; and an output node electrically coupled to said first conductive member at an intermediate point therein, wherein a body lying upon said elongate sensor at a selected point urges said first conductive member into electrical contact with said second conductive member to define an electrical path for output of a sensor signal having a magnitude that varies as a function of location of said selected point along the elongate sensor because of said difference between said first resistance-per-unit-length and said second resistance-per-unit-length.

3. The apparatus according to claim 1 further including an alarm circuit comprising a position detector circuit coupled to said elongate sensor for detecting said magnitude of said sensor signal and comparing that sensor signal magnitude to a predetermined minimum value and producing a position signal if said magnitude of said sensor signal exceeds said predetermined minimum value.

4. The apparatus according to claim 1 further including an alarm circuit comprising an activity detector circuit coupled to said elongate sensor for detecting changes in said magnitude of said sensor signal over time, and comparing said changes in said magnitude over time to a predetermined activity maximum, and producing an activity signal if said changes exceed said predetermined activity maximum.

5. An apparatus for detecting the position of a body lying upon a bed, said apparatus comprising:

an electrical power source;

an elongate sensor including:

an elongate first conductive member having a first selected resistance-per-unit-length;

an elongate second conductive member having a second selected resistance-per-unit-length, which is different from the first resistance-per-unit-length, of said first conductive member, and said elongate second conductive member disposed coextensively with said first elongate conductive member;

an output node electrically coupled to said first conductive member at an intermediate point therein, wherein a body lying upon said elongate sensor at a selected point urges said first conductive member into electrical contact with said second conductive member to define an electrical path for output of a sensor signal having a sensor signal magnitude that varies as a function of location of said selected point along the elongate sensor because of said different between said first resistance-per-unit-length and said second resistance-per-unit-length; and an alarm circuit including:

a position detector circuit coupled to said output node for detecting said sensor signal magnitude and comparing said sensor signal magnitude to a predetermined minimum and a predetermined maximum and producing a position signal if said sensor signal magnitude is without a range defined between said predetermined minimum and said predetermined maximum;

an activity detector circuit coupled to said output node for detecting changes in said sensor signal magnitude over time, and comparing changes in said sensor signal magnitude over time to a predetermined activity maximum, and producing an activity signal if said changes exceed said predetermined activity maximum.

6. The apparatus according to claim 5 wherein said position detector circuit comprises a window comparator.

7. The apparatus according to claim 5 wherein said activity detector circuit comprises a first operational amplifier configured as an integrator, said first operational amplifier coupled to a second operational amplifier configured as a Schmitt trigger.

8. The apparatus according to claim 5 wherein said alarm circuit further includes a logical OR gate, said logical OR gate coupled to said position detector circuit and said activity detector circuit for producing an alarm signal to be received by a nurse interface station in response to said position signal.

9. The apparatus according to claim 5 wherein said alarm circuit further includes a logical OR gate, said logical OR gate coupled to said position detector circuit and said activity detector circuit for producing an alarm signal to be received by a nurse interface station in response to said activity signal.

* * * * *